United States Patent [19]

Doenges et al.

[11] 4,307,388

[45] Dec. 22, 1981

[54] ARRANGEMENT IN ORDER TO PREVENT FALSE ALARMS OF A PASSIVE INFRARED MOTION ALARM

[75] Inventors: Gerhard Doenges, Taunusstein; Thomas Herwig, Schlangenbad, both of Fed. Rep. of Germany

[73] Assignee: Heimann GmbH, Fed. Rep. of Germany

[21] Appl. No.: 157,831

[22] Filed: Jun. 9, 1980

[30] Foreign Application Priority Data

Sep. 19, 1979 [DE] Fed. Rep. of Germany ..... 2937923

[51] Int. Cl.[3] ..... G08B 13/18

[52] U.S. Cl. ..... 340/567; 340/587; 340/600; 340/693

[58] Field of Search ..... 340/567, 600, 587, 693

[56] References Cited

U.S. PATENT DOCUMENTS 3,703,718 11/1972 Berman ..... 340/567

FOREIGN PATENT DOCUMENTS 2103909 8/1971 Fed. Rep. of Germany .

2734157 2/1979 Fed. Rep. of Germany .

*Primary Examiner*—Glen R. Swann, III

*Attorney, Agent, or Firm*—Hill, Van Santen, Steadman, Chiara & Simpson

[57] ABSTRACT

In an infrared motion alarm an optical filter arranged in front of an input of an infrared detector is attached to a heat sink in the form of a solid metal crucible in order to reduce the sensitivity to glass-penetrating electromagnetic radiation. Changes in radiation absorbed in the optical filter are either captured in the thermal sink or decelerated at least as to the characteristic thermal radiation of the optical filter and no longer fall within the characteristic range of change of the motion alarm.

14 Claims, 1 Drawing Figure

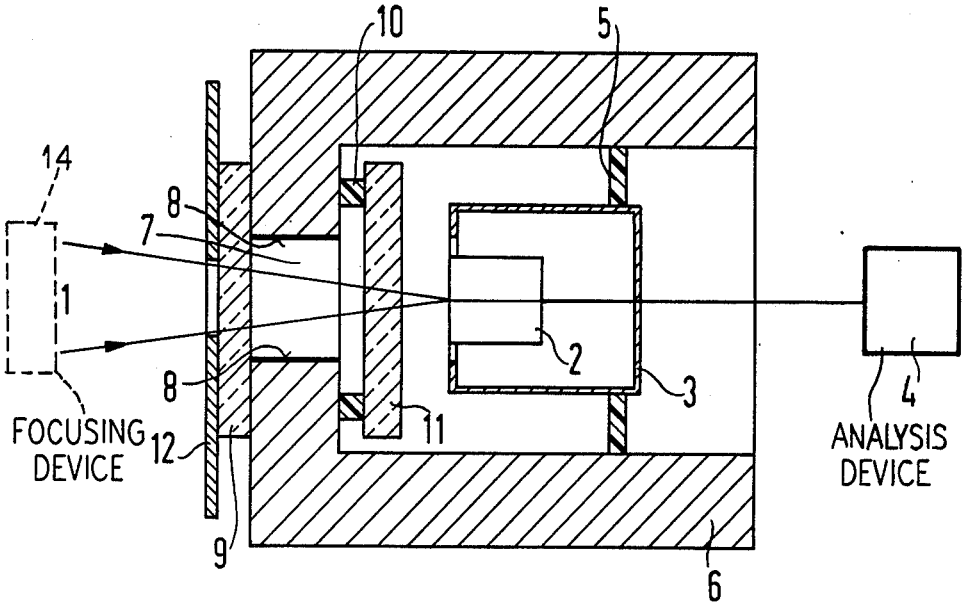
10
5
14
8
7
1
2
3
4
8
11
FOCUSING DEVICE
12
ANALYSIS DEVICE
9
6

ARRANGEMENT IN ORDER TO PREVENT FALSE ALARMS OF A PASSIVE INFRARED MOTION ALARM

BACKGROUND OF THE INVENTION

The invention relates to an arrangement for preventing false alarms of a passive infrared motion alarm.

An arrangement of this kind is known and described, for example, in German Offenlegungsschrift No. 27 34 157 corresponding to U.S. application Ser. No. 924,163, incorporated herein by reference. The fundamental principle is a passive infrared motion alarm which is known, for example, from German Auslegeschrift No. 21 03 909 corresponding to U.S. Pat. No. 3,703,718, incorporated herein by reference. In an infrared motion alarm of this type, changes in incoming thermal radiation are converted into electric signals. Radiation in the wavelength range of greater than approximately 4.5 μm is utilized. In German Offenlegungschrift No. 27 34 157 the fact is taken into account that electromagnetic radiation having a wavelength less than approximately 4.5 μm, thus at wavelengths smaller than the infrared useful range, is withheld from the infrared detector by an appropriate optical filter, but that the radiation withheld by this filter, i.e. absorbed, heats the filter itself and can trigger false alarms in the infrared detector together with the analysis device connected thereto, via the characteristic thermal radiation of the filter which is thus produced. Above all this can be the case if strong light sources, such as car headlights irradiate from the outside of the room which is monitored by the motion alarm through window panes into the monitored room. On the one hand window glass has the advantage that electromagnetic radiation having a wavelength of greater than approximately 4.3 μm is absorbed and that infrared radiation from outside the monitored room does therefore not interfere with the monitoring, but on the other hand allows electromagnetic radiation to pass below this range. This radiation can then trigger false alarms via the secondary effect of the filter heating. In particular, this is the case when the interfering light source has characteristic changes in radiation as is the case in moving car headlights. Their movements lie in the range to which the analysis device responds.

In order to solve this problem it is known from German Offenlegungschrift No. 27 34 157 to provide existing focusing devices with additional filtering actions and to withhold undesired radiation from the actual optical filter either by means of selective absorption or selective reflection. However, an adequately strong filter action can either not be achieved or only with great technical expense, primarily because of the large surfaces of the focusing elements.

SUMMARY OF THE INVENTION

An object of the present invention is to prevent false alarms in a different manner which is more inexpensive and provides improved operation. Focusing elements for such purpose should not be used because of the high and relatively ineffective expense. The application of motion alarms which are protected against false alarms should not depend on the focusing elements.

In order to achieve the objectives of the invention, with the infrared motion alarm system disclosed herein, the optical filter means for withholding electromagnetic radiation having a wavelength less than approximately 4.5 μm from the infrared detector rests on a solid metal plate in highly thermal conductive fashion, preferably at a side which faces towards the infrared detector means. The metal plate has a central opening whose inner surface is mirror-coated to reflect the radiation passing therethrough in wave-guide fashion.

The invention does not apply the method of a filtration of the undesired radiation from the actual optical filter, but ensures, by means of dissipation of heat, that the optical filter directs no disturbing characteristic radiation onto the infrared detector. The solid metal plate together with its good thermal conductivity and large thermal capacity serves as a thermal sink. The construction expense is low. Moreover, the metal plate together with the optical filter and the infrared detector can be designed as a uniform component which is independent of the focusing elements used in the application. The thermal sink has not only the function of the dissipation of heat from the optical filter. It also insures that time changes in undesired incoming radiation smaller than the infrared range can be converted into thermal radiation more slowly. The thermal sink transfers characteristic changes in radiation to outside the range of change to which the motion alarm responds by means of an integrating effect. Thus the sensitivity of the motion alarm to glass-penetrating electromagnetic radiation is substantially reduced.

In an advantageous development, the solid metal plate represents the base of a solid metal crucible in which the infrared detector is contained. It is advantageous if the infrared detector is thermally insulated from the metal crucible.

In accordance with an advantageous design the optical filter consists of a disc, whose thickness to the diameter of the irradiated surface has a ratio of at least 3:8. Thus the thermal capacity of the optical filter contributes to the fact that the speed of change of undesired incoming radiation below the infrared range is converted into changing thermal radiation of the optical filter whose speed of change is slower than the detection range of the analysis device.

In accordance with a further advantageous design a solid metallic diaphragm is arranged on the optical filter on the side which faces away from the infrared detector. On the one hand this diaphragm insures that not more of the filter surface than is necessary for optical reasons is irradiated. On the other hand it likewise has the effect of a thermal sink. This is even intensified if it has an expanse or area which is substantially larger than the opening of its diaphragm.

It is also advantageous if a further optical filter is arranged between the metal plate and the infrared detector. This additional filter is advantageously thermally insulated from the metal plate.

Furthermore, an external mirror-coating of the metal plate and the metal crucible is advantageous. Exterior irradiations onto the metal plate and the metal crucible thus cannot cause any heating.

BRIEF DESCRIPTION OF THE DRAWING

The drawing illustrates an exemplary embodiment of an arrangement in accordance with the invention.

DESCRIPTION OF THE PREFERRED EMBODIMENTS

1 designates the electromagnetic radiation which is focused onto an infrared detector 2. The latter is contained in a housing 3 and electrically connected to an analysis device 4, such as described in the aforementioned references. The housing 3 is fixed via a thermally insulating suspension 5 in a massive metal crucible 6. In addition to a thick cylindrical wall this crucible possesses a thick base which has a central cylindrical opening 7 whose inner surface 8 is mirror-coated. An optical filter 9 in the form of a disc is located on the outer side of the base in thermally highly conductive fashion and is positioned so as to cover the opening 7. A further optical filter 11, similar to optical filter 9 and likewise covering the opening 7, is located on the inside of the base via a thermally insulating spacer 10. Above the optical filter 9, on the side which faces away from the opening 7, there is arranged a metal diaphragm 12 having a central diaphragm opening and an expanse or area which radially projects over and beyond the disc of the optical filter 9.

The focused electromagnetic radiation is fed by the focusing device 14 (such as described in the aforementioned publications) through the diaphragm 12, the optical filter 9, the opening 7 and through the optical filter 11 onto the infrared detector 2. The opening 7 having the metal-coated wall surface acts as a waveguide. The optical filters 9 and 11 are semiconductor discs which consist, for example, of germanium and are vapour-deposited with interference layers. The ratio between their thickness and the diameter of the irradiated surface is at least 3:8. Electromagnetic radiation which is absorbed by the filter 9 produces heat there. This heat is both absorbed by the thermal capacity of the filter disc, which is relatively high because of the thickness, and also dissipated onto the diaphragm 12 and the metal crucible 6 via a thermally highly conductive connection. Primarily on the side of the filter 9 which faces towards the infrared detector 2, as a thermal sink the metal crucible 6 ensures that the filter surface above the opening 7 can direct only minimal characteristic thermal radiation onto the infrared detector 2. The thermal absorbing capacity of the metal crucible 6 at least ensures that changes in radiation are substantially decelerated to such an extent that their assigned converted electrical signals no longer fall within the range to which the analysis device 4 responds. An exterior mirror coating of the metal crucible 6 reduces outer influences by radiation onto the metal crucible 6 itself.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An arrangement for preventing false alarms of a passive infrared motion alarm, comprising:

(a) means for focusing electromagnetic radiation coming from at least one angle onto an infrared detector means;

(b) in front of the infrared detector means optical filter means for withholding electromagnetic radiation having a wavelength less than approximately 4.5 μm from the infrared detector means;

(c) the infrared detector means producing an electric signal from the received radiation and transmitting it to an analysis means for analyzing characteristic time changes of the electric signal for alarm purposes;

(d) said optical filter means resting on a solid metal plate in highly thermal conductive fashion at a side which faces towards the infrared detector means; and (e) the metal plate having a central opening whose inner surface is mirror-coated to reflect the radiation passing through the opening and directed onto the infrared detector means.

2. An arrangement of claim 1 wherein the metal plate forms a base of a solid metal crucible in which the infrared detector means is contained.

3. An arrangement of claim 2 wherein the infrared detector means is thermally insulated from the metal crucible.

4. An arrangement of claim 1 wherein the optical filter means comprises a disc whose thickness compared to a diameter of the irradiated surface has a ratio of at least 3:8.

5. An arrangement of claim 1 wherein on the optical filter means on the side facing away from the infrared detector means is arranged a solid metal diaphragm.

6. An arrangement of claim 5 wherein the solid metal diaphragm has a substantially larger expanse or area than the diaphragm opening.

7. An arrangement of claim 1 wherein a further optical filter means is arranged between the metal plate and the infrared detector means.

8. An arrangement of claim 7 wherein the further optical filter means is thermally insulated from the metal plate.

9. An arrangement of claim 1 wherein the metal plate is mirror-coated on the outside.

10. An arrangement of claim 1 wherein a metal crucible is provided with the metal plate forming a base thereof, and the metal crucible is mirror-coated on the outside.

11. The arrangement of claim 1 wherein the central opening of the metal plate is cylindrical.

12. An arrangement for preventing false alarms of a passive infrared motion alarm, comprising: an infrared detector means for producing an electric signal from incident electromagnetic radiation and transmitting it to an analysis means for analyzing characteristic changes of the electric signal for alarm purposes; in front of the infrared detector means optical filter means for filtering out electromagnetic radiation having a wavelength less than approximately 4.5 μm from the infrared detector; said optical filter means resting on a solid metal surface in highly thermal conductive fashion; and the metal surface having a central opening positioned for transmission of the radiation therethrough and onto the infrared detector.

13. The arrangement of claim 12 wherein the metal surface comprises a base of a metal container within which the infrared detector means is mounted in thermally insulated fashion, said optical filter means being mounted on an exterior surface of the base of the metal container in highly thermal conductive fashion.

14. The arrangement of claim 12 wherein the means for analyzing measures characteristic time changes of the electric signal for alarm purposes.

* * * * *